US005676638A

United States Patent [19]

Shefi

[11] Patent Number: 5,676,638

[45] Date of Patent: Oct. 14, 1997

[54] STRAP-MOUNTED MASSAGING DEVICE

[76] Inventor: Amos Shefi, POB 6201, Netanya, Israel, 42160

[21] Appl. No.: 409,102

[22] Filed: Dec. 8, 1994

Related U.S. Application Data

[63] Continuation of Ser. No. 11,131, Jan. 29, 1993, abandoned.

[30] Foreign Application Priority Data

Feb. 6, 1992 [IL] Israel ..... 100886

[51] Int. Cl.[6] ..... A61H 11/00; A61H 15/00

[52] U.S. Cl. ..... 601/124; 601/125; 601/128; 601/132; 601/143

[58] Field of Search ..... 601/122, 124, 601/125, 128, 132, 143

[56] References Cited

U.S. PATENT DOCUMENTS

| | | | |
|---|---|---|---|
| 863,144 | 8/1907 | Bowser | 128/58 |
| 1,513,475 | 10/1924 | Bell | 128/58 |
| 1,611,767 | 11/1926 | Geraldine | 128/58 |
| 1,999,939 | 4/1935 | Luzzi | 601/125 |
| 2,011,471 | 8/1935 | Casagrande et al. | 601/128 X |
| 2,227,724 | 1/1941 | Kosa, Sr. | 128/58 |
| 2,621,652 | 12/1952 | Ehrhardt | 128/57 |
| 2,638,089 | 5/1953 | Murphy | 128/57 |
| 3,060,928 | 10/1962 | Lowe | 601/128 |
| 3,672,358 | 6/1972 | Majewski | 601/132 |
| 3,861,382 | 1/1975 | Simjian | 128/58 |
| 3,959,841 | 6/1976 | Horne | 128/63 X |
| 3,960,144 | 6/1976 | Simjian | 128/58 |
| 3,970,078 | 7/1976 | Rogers, Jr. | 601/125 |
| 4,191,179 | 3/1980 | Mattila | 601/132 |
| 4,526,184 | 7/1985 | Caruso | 132/251 X |
| 5,174,282 | 12/1992 | Bleggi | 601/128 |

FOREIGN PATENT DOCUMENTS

| | | | |
|---|---|---|---|
| 1313111 | 11/1962 | France | 128/57 |
| 2725869 | 4/1978 | Germany | 601/128 |

*Primary Examiner*—Danton D. DeMille
*Attorney, Agent, or Firm*—Edward Langer

[57] ABSTRACT

A massaging device constructed as a set of massaging elements comprising disc-shaped rollers rotatably mounted on the ends of a plurality of transversely-positioned axles spaced apart along the length of a strap and retained by the strap. The axles and rollers are designed so that the axles are flush-mounted with the outer face of the rollers, and the axles do not project beyond the rollers, eliminating any possibility of injuring the skin while massaging. The strap is designed to insure that the massaging elements do not become entangled, while preserving the stability and flexibility of the device. The ends of the strap are provided with wide handles, providing additional comfort during use. The inventive design provides an inexpensive, light, sturdy, safe and easy-to-use massaging device.

3 Claims, 2 Drawing Sheets

STRAP-MOUNTED MASSAGING DEVICE

This is a continuation of application Ser. No. 08/011,131 filed on Jan. 29, 1993 now abandoned.

FIELD OF THE INVENTION

The present invention relates to massaging devices generally, and more particularly, to an improved massaging device having rollers oppositely-mounted along the edges of a strap.

BACKGROUND OF THE INVENTION

There are known massaging devices constructed as a set of wheels or balls each rotating on an axis provided between two parallel cords, with the ends provided with handles, such as disclosed by German patent 2,725,869. A simple variation of this design is disclosed in German patent 2,126,153, where the handles are provided as rings. In German patent 2,218,878, a rigid frame is provided having a multiple of balls on each transverse axis, and a similar design without the frame is disclosed in German patent 2,323,851.

In another design, such as that disclosed by British patent 2,100,604, the balls are mounted between two cords extending parallel to one another and being maintained apart from one another by transverse axles. Plastic sleeves seated over the cords are used to keep the axles spaced apart from one another at fixed intervals along the cord length, like the rungs of a ladder. The parallel cords and sleeves form the frame, which holds the bails in place, and retains them on the transverse axles. Rings provided at either frame end serve as handles.

A disadvantage of this construction is that the transverse axles project beyond the frame, so that when the device is vigorously applied to massage the body, these projections may scratch or injure the skin.

The prior art designs for massaging devices based on the use of a frame formed by cords is difficult to use since the entire length often becomes entangled and must be straightened out before use. Also, these designs use wooden parts which are non-washable, limiting the ability to clean and maintain them. The use of many parts complicates and slows production, especially where the cords must be threaded through each part.

In addition, this design causes noise as a result of friction developed between the wooden parts and the cord frame. This friction also shortens the useful life of the device.

Another variation of a massaging device design is provided in U.S. Pat. No. 4,210,135 to Deuser, in which a plurality of massaging members shaped as discs are held on a flexible shaft in a bow shape. Since this device is manipulated by one hand, only a limited amount of force is developed while massaging against the body.

In view of the limitations in prior art massaging device design, it would be desirable to provide a simply constructed, safe, inexpensive and easy-to-use massaging device.

SUMMARY OF THE INVENTION

Accordingly, it is a principal object of the present invention to overcome the above-mentioned disadvantages of the prior art and provide a strap-mounted massaging device featuring a strap having sets of rollers oppositely-mounted on its edges.

In accordance with a preferred embodiment of the present invention, there is provided a strap-mounted massaging device comprising:

a flexible strap;

a plurality of axles each extending transverse to said strap and being retained thereon; and a plurality of rotatable massaging elements arranged in sets mounted over the ends of each of said axles.

In the preferred embodiment, the massaging device is constructed as a set of massaging elements comprising disc-shaped rollers rotatably mounted on the ends of a plurality of axles spaced apart along the length of a strap. The strap is provided as a two-layered material sewn together with the axles retained in pockets formed between the layers. The axles and rollers are designed so that the axles are flush-mounted with the outer face of the rollers, and the axles do not project beyond the rollers, eliminating any possibility of injuring the skin while massaging.

The inventive design overcomes the disadvantages of prior art designs by use of the strap for mounting the massaging elements. The strap is designed to insure that the massaging elements do not become entangled, while preserving the stability and flexibility of the device. The ends of the strap are provided with wide handles, providing additional comfort during use.

In addition, the inventive design simplifies production and reduces production costs by reducing the number of components. Also, the roller massaging elements are manufactured from plastic by injection molding, then mounted on the axles and mechanically locked thereon. Several techniques exist for mechanically locking the rollers on the axles, including thermoplastic or mechanical deformation of the axle ends, or use of a fastener cap, screw or other fastener.

The use of plastic components for the massaging elements enables greater manufacturing precision and reduced tolerances between the axles and elements, decreasing the noise associated with use of the device.

By virtue of its unique design, an inexpensive, light, sturdy, safe and easy-to-use massaging device can be manufactured.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1:
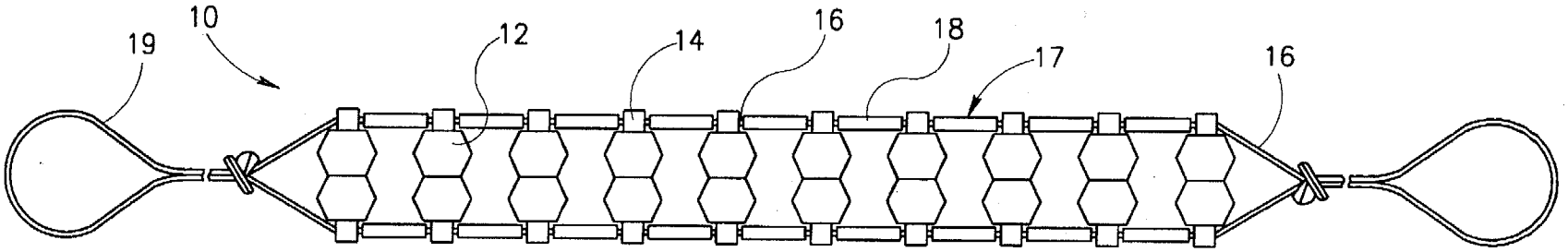
FIG. 1 (PRIOR ART)
FIG. 1 is a top view of a prior art massaging device constructed using wooden rollers in a frame formed by cords.

Referring now to FIG. 1, there is shown a top view of a prior art massaging device 10, which is a design representative of several similar prior art devices, as mentioned in the background. Device 10 is constructed using wooden rollers 12 mounted on axles 14 which are seated transverse to a pair of cords 16 forming a frame 17. The individual axles 14 are maintained spaced apart within frame 17 by a set of plastic spacers 18 through which cords 16 are threaded. The cord 16 ends form loops 19, providing handles to manipulate device 10 in use.

A disadvantage of this construction is that the transverse axles 14 project beyond the cord frame 17, so that when the device 10 is vigorously applied to massage the body, these projecting axles 14 may scratch or injure the skin.

The prior art designs for massaging devices based on the use of a frame formed by cords is difficult to use since the entire length often becomes entangled and must be straightened out before use. Also, these designs use wooden parts which are non-washable, limiting the ability to clean and maintain them. The use of many parts complicates and slows production, especially where cords 16 must be threaded through each part.

Figure 2:
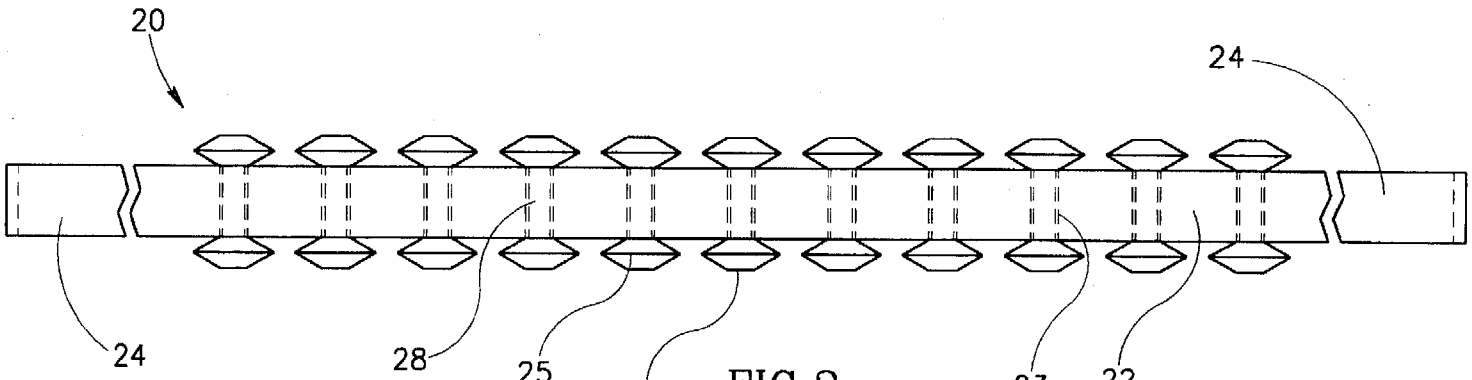
FIG. 2 is a top view of preferred embodiment of a strap-mounted massaging device constructed in accordance with the principles of the invention.

Referring now to FIG. 2, there is shown a top view of a preferred embodiment of a strap-mounted massaging device 20 constructed in accordance with the principles of the present invention. Device 20 comprises a strap 22 with a desired length, with each of it ends folded over itself as a loop to provide handles 24. Massaging elements 25 are formed with a central hole, are shaped as disc-shaped rollers and are rotatably mounted in pairs on a plurality of axles 26 spaced apart perpendicular to the length of strap 22. The strap 22 comprises two layers of material sewn together by stitches 23, forming a plurality of pockets 28 for retaining each axle 26 between strap 22 layers.

Each axle 26 is provided with a length equivalent to the strap 22 width plus the thickness of a pair of massaging elements 25. Massaging elements 25 are designed to be locked on axles 26 such that the end of each axle 26 is flush-mounted with the outer face of each element 25, forming a substantially continuous surface such that axle 26 does not project beyond it, nor is axle 26 recessed in the hole of massaging element 25.

It will be appreciated that in an alternative design, massaging elements 25 may be ball-shaped, wheel-shaped or gear-shaped elements, or elements having smooth edges, or they can be shaped to achieve a desired physiotherapy effect.

Figure 3:
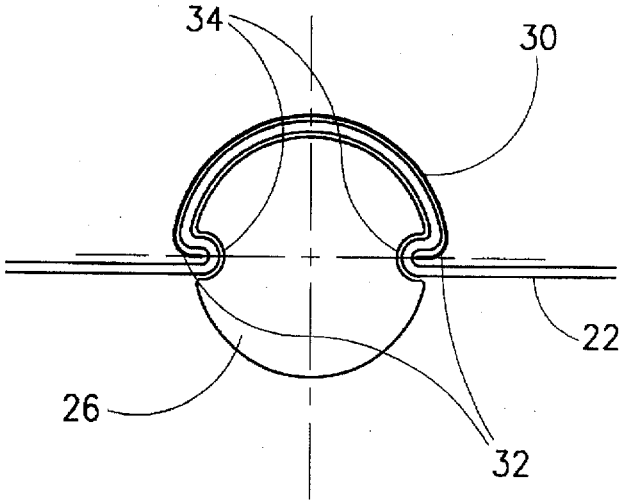
FIG. 3 illustrates a side view of an alternative embodiment of the strap of FIG. 2, featuring a spring clamp for retaining transversely-mounted axles on the strap.

In FIG. 3, there is shown a side view of an alternative embodiment of the strap 22 of FIG. 2, featuring a spring clamp 30 for retaining axles 26 transversely-mounted on strap 22. In this embodiment, strap 22 is provided as a single layer of material. Spring clamp 30 is typically made of metal and is formed with a semi-circular profile with inwardly facing edges 32. In this embodiment, axles 26 are formed with a pair of parallel grooves 34. To attach strap 22 to each axle 26, axle 26 is placed into the clamp 30 such that strap 22 is pressed between them, and clamp 30 edges 32 engage grooves 34, and retain strap 22 therein. Other clamps or buckles may be used for this purpose.

Figure 4:
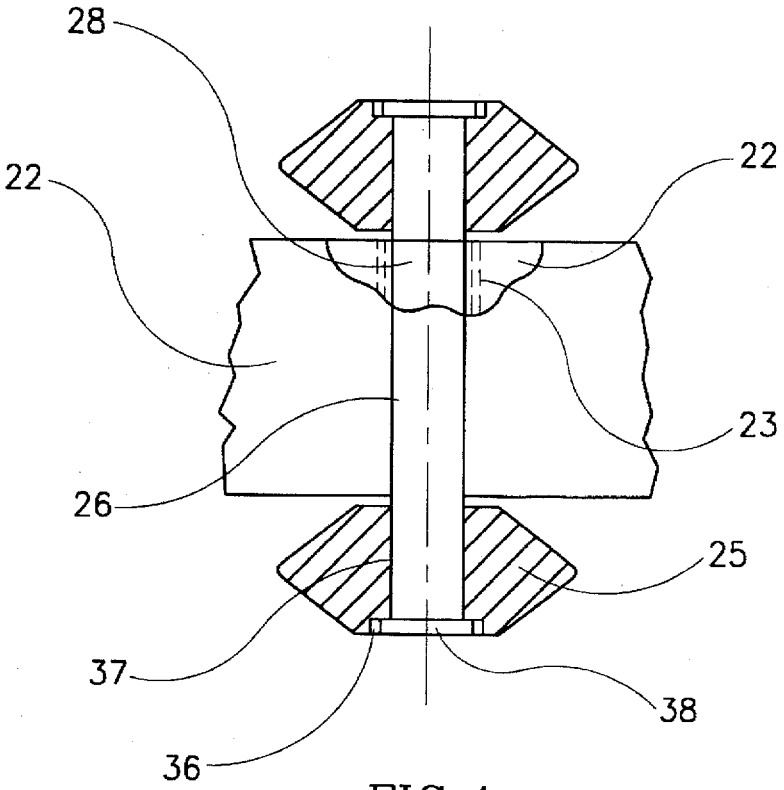
FIG. 4 is a detailed view of a portion of the massaging device of FIG. 2, showing massaging elements mounted on an axle.

In FIG. 4, a detailed view is shown of a portion of the massaging device of FIG. 2, showing massaging elements 25 mounted on axle 26 in locking fashion. For this purpose, a circular depression 36 is formed in the outer face of massaging element 25, with a diameter slightly larger than that of hole 37 formed in each massaging element 25. The ends of each axle 26 are shaped with a locking shoulder 38 which matches the contour of circular depression 36, and which retains massaging element 25 on axle 26.

There are several methods of forming locking shoulder 38 on axle 26, and among these are thermoplastic or mechanical deformation of the ends of axles 26. In addition, an enlarged end piece can be glued or otherwise attached to the axle. A fastener clamp or screw can also be used. Thus, the ends of axles 26 are flush-mounted with the outer face of massaging elements 25.

If the thermoplastic deformation method is used, first the axles 26 are placed in pockets 28 on strap 22. Massaging elements 25 are then mounted on axles 26. Then, each axle 26 is oriented vertically and mechanical pressure is applied combined with heating above and below axle 26, for a period as required in accordance with the type of material. Before pressure is applied, massaging element 25 is moved away from the end of axle 26 so as to avoid being damaged by the heat. This can be done by squeezing strap 22 to narrow it slightly, and then releasing it once the deformation has been completed. This method results in widening the ends of axles 26, while shortening their length slightly.

In use, strap-mounted massaging device 20 is held by its handles 24 so that massaging elements 25 contact the body. Device 20 is then drawn over the body area which is to be massaged with a desired force and speed. Massaging elements 25 rotate freely and provide stimulation to the skin and muscles in accordance with the force applied.

In summary, the flush-mounted design of axles 26 with the outer face of massaging elements 25 insures that axles 26 do not project beyond the discs, eliminating any possibility of injuring the skin while massaging.

The inventive design overcomes the disadvantages of prior art designs by use of strap 22 for mounting the massaging elements. The strap 22 is designed to insure that massaging elements 25 do not become entangled, while preserving stability and flexibility of the device. The ends of strap 22 are provided with wide handles 24, providing additional comfort during use.

In addition, the inventive design simplifies production and reduces production costs since massaging elements 25 can be manufactured from plastic by injection molding, then mounted on axles 26 and mechanically locked thereon.

The use of plastic components for massaging elements 25 enables greater manufacturing precision, allowing for reduced tolerances in the fit between the axles 26 and elements 25, and decreasing the noise associated with use of the device 20.

Having described the invention with regard to certain specific embodiments thereof, it is to be understood that the description is not meant as a limitation, since further modifications may now become apparent to those skilled in the art and it is intended to cover such modifications as fall within the scope of the appended claims.

I claim:

1. A method of construction of a strap-mounted massaging device, said device comprising:

a flexible strap;

a plurality of axles spaced apart along the length of said strap, each axle extending transverse to said strap and being retained thereon; and a plurality of freely rotatable massaging elements each comprising a disc-shaped roller having a tapered circumferential rim and an outer face, each of a pair of said rollers being mounted over an opposite end of each of said axles, said method of construction comprising thermoplastically-deforming said axle ends to provide a locking shoulder for retaining thereon said disc-shaped rollers, said method comprising the steps of:

placing each of said plurality of axles along the length of said flexible strap and retaining it thereon;

placing each of said disc-shaped rollers over the opposite ends of each of said axles to mount them thereon;

pushing said mounted disc-shaped rollers toward each other on said axle;

squeezing said strap so as to narrow its width between said disc-shaped rollers and provide clearance at said axle ends;

thermoplastically-deforming said axle ends to provide said locking shoulder; and releasing said squeezed strap and restoring its width.

2. The method of claim 1 wherein during said step of thermoplastically-deforming said axle ends, each of said axle ends is flush-mounted and forms a substantially continuous surface with said outer face of each of said disc-shaped rollers.

3. The device produced in accordance with the method of claim 1 wherein said axles are formed with parallel grooves extending therein, and further comprising a clamp shaped to engage said grooves and retain said strap therein.

* * * * *